US007367259B2

(12) United States Patent
Beck

(10) Patent No.: US 7,367,259 B2
(45) Date of Patent: May 6, 2008

(54) PRESSURE PIN AND AXIAL PISTON MACHINE HAVING SAID PRESSURE PIN

(75) Inventor: Josef Beck, Villingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 248 days.

(21) Appl. No.: 10/549,742

(22) PCT Filed: Mar. 19, 2004

(86) PCT No.: PCT/EP2004/002897

§ 371 (c)(1),
(2), (4) Date: Sep. 19, 2005

(87) PCT Pub. No.: WO2004/083635

PCT Pub. Date: Sep. 30, 2004

(65) Prior Publication Data

US 2006/0174758 A1 Aug. 10, 2006

(30) Foreign Application Priority Data

Mar. 19, 2003 (DE) ..... 103 12 242

(51) Int. Cl.
*F01B 3/02* (2006.01)

(52) U.S. Cl. ..... 92/71

(58) Field of Classification Search ..... 92/12.2, 92/57, 71

See application file for complete search history.

(56) References Cited

U.S. PATENT DOCUMENTS

| | | | | |
|---|---|---|---|---|
| 3,139,038 A | | 6/1964 | Stewart | |
| 3,643,549 A | | 2/1972 | Nagatomo | |
| 4,464,979 A | | 8/1984 | Forster | |
| 5,189,766 A | * | 3/1993 | Weber | 411/920 |
| 5,722,298 A | | 3/1998 | Schwarzbich | |
| 5,730,043 A | * | 3/1998 | Kristensen et al. | 92/57 |
| 5,941,159 A | | 8/1999 | Hansell et al. | |

FOREIGN PATENT DOCUMENTS

| | | |
|---|---|---|
| DE | 703 514 | 3/1941 |
| DE | 36 27 698 A1 | 2/1988 |
| DE | 42 01 393 C1 | 6/1993 |
| DE | 196 10 595 C1 | 10/1998 |
| DE | 196 00 631 A1 | 7/1999 |
| DE | 199 00 147 C2 | 3/2002 |

* cited by examiner

*Primary Examiner*—F. Daniel Lopez
(74) *Attorney, Agent, or Firm*—Scully, Scott, Murphy & Presser, P.C.

(57) ABSTRACT

An axial piston machine (1) having a rotatably mounted cylinder drum (5) which in turn has a center recess (38) and a plurality of cylinder bores (6) that extend substantially axially relative to the center bore (38) and in which pistons (7) are movably guided and are supported on a pivoting plate (11) via sliding shoes (8). The sliding shoes (8) are guided in recesses (23) of a withdrawal plate (22) in whose contact inner bore (25) a withdrawal body (16) is guided with an outer surface that corresponds to the inner bore (25) of the withdrawal plate (22). The withdrawal body (16) is subject to an axially directed pretension force which is exerted by a compression spring (26) via the pressure pins (28). Every pressure pin (28), on its base side (40), is provided with an enlarged portion (43) radially in relation to its longitudinal axis (34).

14 Claims, 6 Drawing Sheets

PRESSURE PIN AND AXIAL PISTON MACHINE HAVING SAID PRESSURE PIN

BACKGROUND OF THE INVENTION

1. Field of the Invention

The invention relates to a pressure pin with lower wear transmission of a pretensioning force to a return member in an axial piston machine.

To generate a cyclical intake and compression stroke in the individual cylinders of a cylinder drum in an axial piston machine, a swash plate is used, which, on rotation of the cylinder drum, causes the pistons in the individual cylinders to effect a cyclical reciprocating motion by means of guide shoes which are connected to the pistons and are supported on the swash plate, continuously on a circular band concentric to the axis of rotation in accordance with the rotational movement. To ensure defined support of the guide shoes on the swash plate, a pressure acting in the direction of the swash plate is exerted on the return plate carrying the individual guide shoes via a return member, which is connected with the drive shaft of the cylinder drum. To this end, the pretensioning force of a compression spring, which is guided over the drive shaft of the cylinder drum, is applied to the return member via a plurality of pressure pins.

Transmission of the pretensioning force from the compression spring via a plurality of pressure pins to the return member has caused problems in the past. Solutions in which the pressure pins are guided in separate grooves in the drive shaft require additional spring retainers for local stabilization of the pressure pins in the grooves, which complicates the assembly process and also increases unnecessarily the manufacturing costs of the axial piston machine due to the production and storage of additional components. Advanced solutions, in which the pressure pins are fixed for better guidance in grooves with limited lateral dimensions without using additional components, have the disadvantage that the pressure pins are freely rotatable against the surfaces opposite their end faces. To minimize the resultant increased wear, harder materials are required, which likewise increase unnecessarily the manufacturing costs for the axial piston machines.

2. Discussion of the Prior Art

The pressure pins in DE 198 00 631 A1 no longer exhibit the disadvantage of free rotatability relative to the surfaces adjoining the end faces (surface of the return member, surface of the spring washer), since an interference fit is provided between the pressure pins and the spring washer via a retaining hook mounted on the pressure pin in its end-face surface enlargement. A disadvantage of this embodiment, however, is that the pressure pins perform oscillating and micro-movements against the return plate. This leads to unnecessary wear to pressure pins and return plate and thus to an unintentional reduction in the pretensioning force of the return member.

SUMMARY OF THE INVENTION

The object of the invention, therefore, is so to develop an axial piston machine having features and at least one pressure pin having features such that any wear to the pressure pins and return member as a result of oscillating and micro-movements of the pressure pin against the return member no longer occurs. Moreover, the invention should additionally fulfill the requirements resulting from the above-stated problems:

- no use of additional components
- no lateral or radial displacement of the pressure pins after installation
- no rotational movement between end faces of the pressure pins and adjacent surfaces of opposing components (return member, spring washer)
- easy assembly of the components
- economic viability of manufacture
- long service life
- simple construction.

As a result of the expansion of the end face of the pressure pin, which preferably entails at least doubling of the end face of the original pressure pin, the pretensioning force is distributed to the return member over a significantly greater bearing surface. Therefore, the mechanical stress to which the return member and also the pressure pins are exposed is markedly less, which results in less wear to the components. As a result of this reduced wear to the components, it is possible to dispense with hardening of the components or to use softer materials, such as for example brass or bronze, for the return member.

The construction of a retaining hook at the edge of the surface enlargement of the pressure pin makes it possible, in combination with a bore matching the retaining pin in the surface of the return member, to fix the pressure pin in definite manner in the radial and also sideways directions. Possible radial and sideways movement of the pressure pin is additionally prevented by the provision of a second retaining hook at the edge of the surface enlargement at the other end of the pressure pin, which hook produces an interference fit with the spring washer in combination with the surface enlargement. Such an embodiment ensures that the pressure pin can no longer become detached prior to fitting of the drive shaft.

By fixing the pressure pin by means of the retaining hook to the bore in the return member, additional rotary motion of the pressure pin relative to the return member, resulting in additional wear to the components, is also ruled out. Due to the interference fit between spring washer and retaining hook or surface enlargement of the pressure pin, rotary motion relative to the adjacent spring washer is also no longer realistically possible at this end of the pressure pin.

Assembly is also relatively simple, since on the one hand no additional components are required and on the other hand unintentional incorrect assembly is ruled out as a result of the mirror-image construction of the pressure pin at the top and bottom ends. As a result of exact fixing of the pressure pin to the return member or to the spring washer, slippage of the pressure pin during assembly is impossible, which allows reliable fitting of the pre-assembled driving gear group (drive shaft, cylinder drum, return member, return plate) via the interconnecting shaft spline profile.

Due to the rigid connection between the drive shaft and the return member via the pressure pin and the bore in the return member, the shaft splines between drive shaft and return member as part of the pre-assembled driving gear group are made obsolete as a further advantage of the invention and may optionally not be provided.

Exemplary embodiments of the invention are described in more detail below and illustrated in the drawings, in which:

The axial piston machine according to the invention and the pressure pin with enlarged bearing surface is described below with reference to FIG. 1 to FIG. 5.

Figure 1:
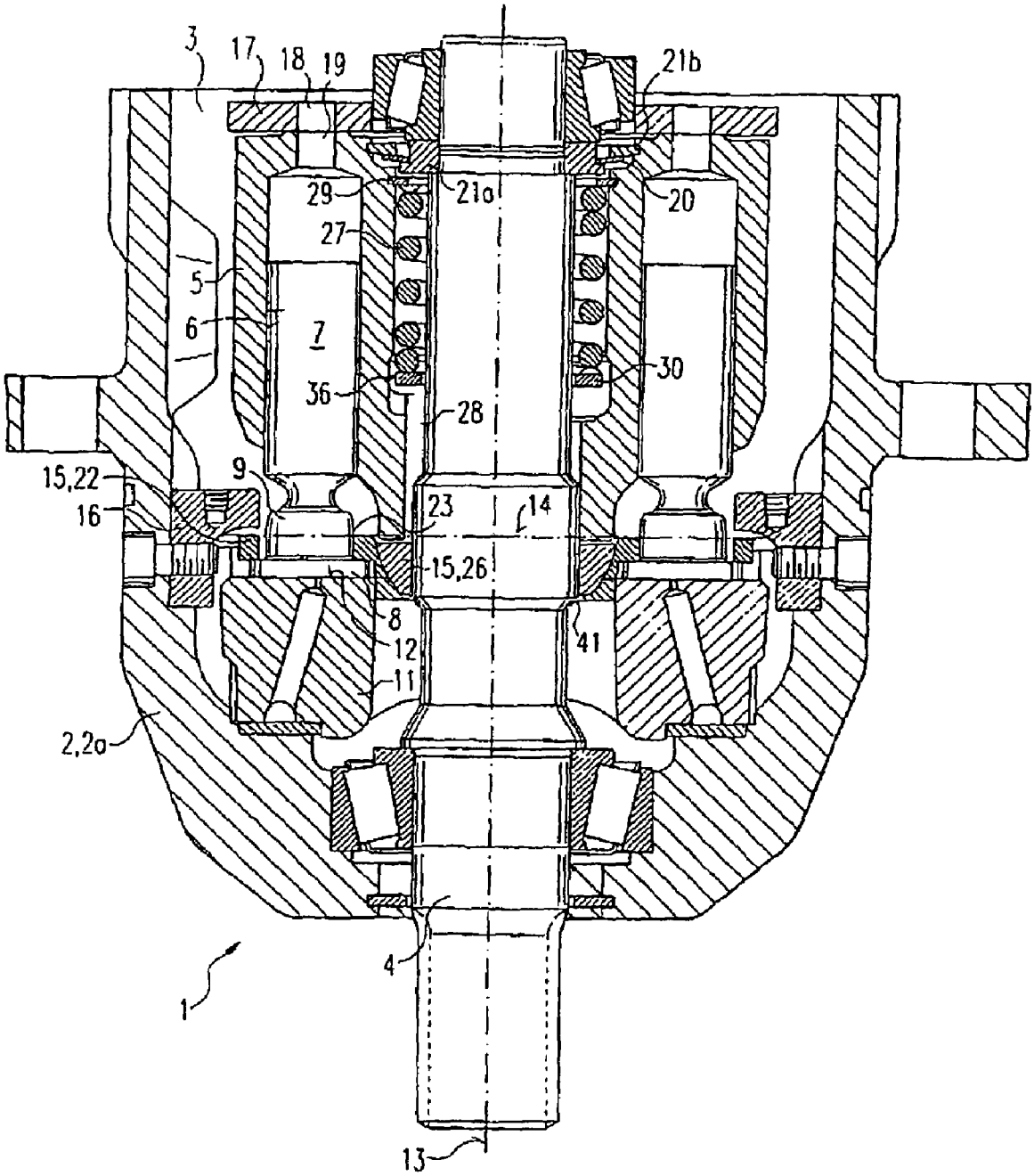
Fig. 1 Prior Art
FIG. 1 shows a cross-section through an axial piston machine, characterizing the prior art.
Figure 2:
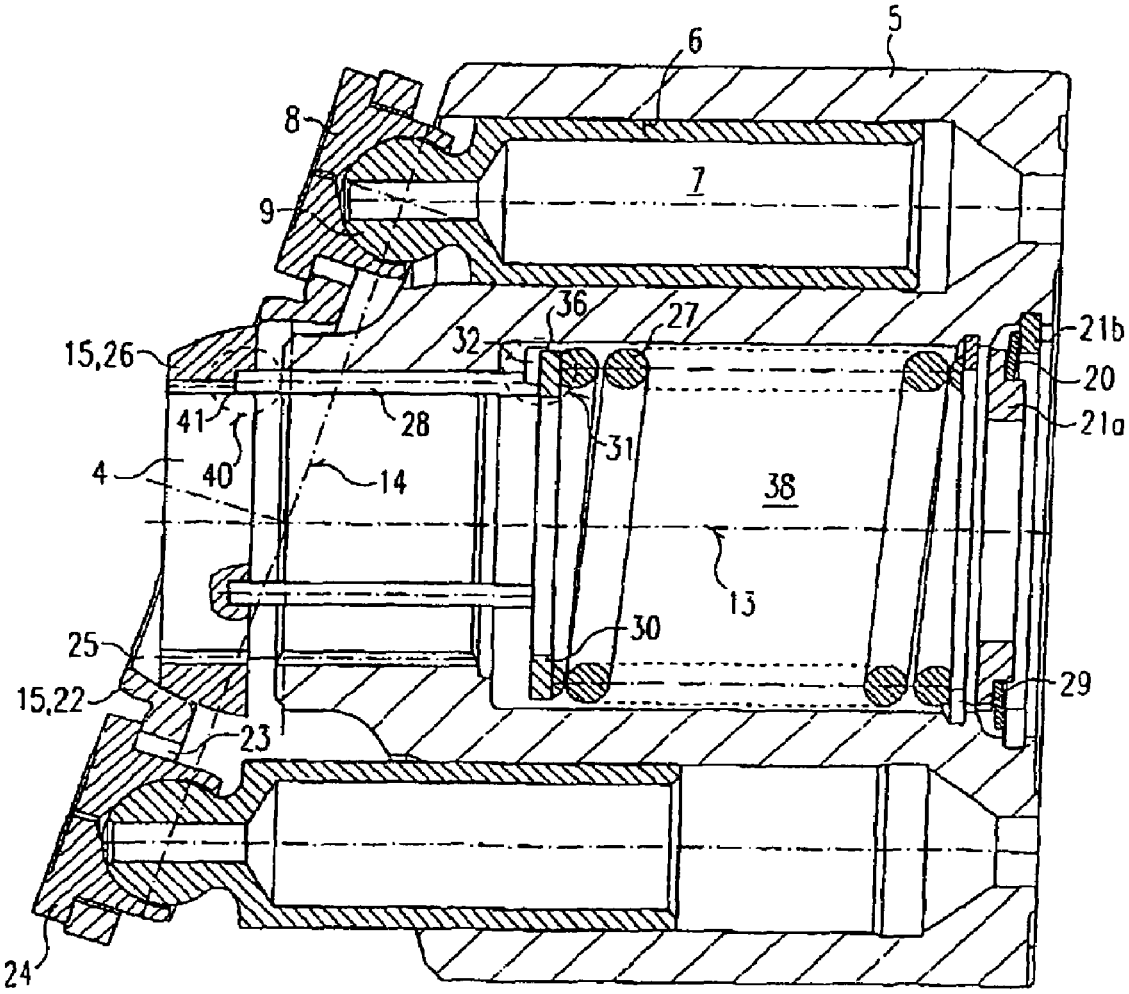
Fig. 2 Prior Art
FIG. 2 shows a cross-section through the components of an axial piston machine which are relevant according to the prior art to pretensioning of the return member.

FIGS. 1 and 2 show cross-sections through an axial piston machine according to the prior art. The main components of the axial piston machines designated overall as 1 are a housing 2 with a housing wall 2*a* visible in section in the drawings and enclosing a housing interior 3, in which there is arranged on a shaft 4 a cylinder drum 5 with a plurality of longitudinally directed cylinder bores 6 preferably distributed over a partial circle, with a plurality of pistons 7, which are arranged axially displaceably in the cylinder bores 6, with a plurality of guide shoes 8, which are connected swivellably but axially fixedly to spherical piston heads 9 at one end of the pistons 7, with a swash plate taking the form of a swivellable swivel plate 11, the guide shoes 8 resting and being axially supported against the inclined surface 12 of said swivel plate, wherein the swivel plate 11 is mounted in an oscillating bearing 14*a* (not shown) so as to be swivellable about a swivel axis 14 extending at right angles to the longitudinal central axis 3 of the axial piston machines 1 or the axis of rotation of the shaft 4 by an adjusting device (not shown) and fixable in the respective swivel position, with a return means 15, whose purpose is to secure the guide shoes 8 in their position resting against the inclined surface 12, with a retaining means 16, which is provided to stabilize the return means 15, and with a control plate 17, which rests, on the side remote from the swivel plate 11, against the cylinder drum 5 and controls conveyance of the in this case hydraulic medium of the axial piston machine 1 by means of metering slots 18 arranged in the control plate 17 and cylinder bore holes 19 in the cylinder drum 5 cooperating therewith. A Belleville spring washer 20 pretensioning the cylinder drum 5 against the control plate 17 and mounted in the two mounting rings 21*a* and 21*b* ensures that the cylinder drum 5 and the control plate 17 sit tightly against one another.

The return means 15 is formed of a return plate 22 with holes 23 corresponding in number to the guide shoes 8, the edges of said holes surrounding the guide shoes 8 with play in the area of tapered guide shoe heads and resting with their sides facing the swivel plate 11 against a bottom flange 24 of the associated guide shoe 8, such that the bottom flange 24 is held with slight play between the inclined surface 12 and the swivel plate 11. The return plate 22 itself comprises a central internal bore 25 at its side remote from the swivel plate 11, which internal bore 25 tapers in the direction of the swivel plate 11. With its internal bore 25 tapering in the direction of the swivel plate 11, the return plate 22 presses on the return member 26 associated with the return means 15. This return member 16 comprises a surface in the shape of a segment of a sphere, which is in contact with the central internal bore 25 of the return plate 22.

The force of the return means 15 acting in the direction of the longitudinal axis 13 of the drive shaft 4 for ensuring that the guide shoes 8 rest securely against the inclined surface 12 is supplied to the return means 15 as the pretensioning force of a pretensioned compression spring 27 via a plurality of pressure pins 28. The compression spring 26 is guided over the drive shaft 4 in a recess in the cylinder drum 5 and is held under tension between a spring ring 29 fixed in the cylinder drum 5 in the region of the control plate 17 and a spring washer 30 guided movably over the drive shaft 4 in the direction of the longitudinal axis 13 thereof in the region of the return means 15.

To transmit the pretensioning force of the compression spring 27 via the spring washer 30 to the pressure pins 28, each pressure pin 28 comprises according to the invention a surface enlargement 32 at its top end 31 facing the spring washer 30. In the exemplary embodiment, the surface enlargement 32 is a flange pointing radially to one side of the longitudinal axis 33 of the pressure pin 28, which flange expands the end face of the cylindrical basic member 34 by the end face of the surface enlargement 32 likewise of planar construction and pointing in the same direction as the end face of the cylindrical basic member 34, to produce the bearing surface 35. At the outer end of the surface enlargement 32, a pointed retaining hook 36 projects perpendicularly out of the bearing surface 35.

Connection between the spring washer 30 and each pressure pin 28 is brought about in that the spring washer 30 rests on the bearing surface 35 of each pressure pin 28 and is fixed to the pressure pins 28 by the retaining hook 36 at the outer edge of the surface enlargement 32 of each pressure pin 28 in the manner of an interference fit. According to FIG. 5, each pressure pin 28 is guided with its cylindrical basic member 34 in a groove 37 in the inside of the central recess 38 of the cylinder drum 5 provided with a spline profile. The pressure pin 28 is fixed in the groove 37 by the surface 39, provided with a corresponding spline profile, of a drive shaft 4 engaging in the central recess 38 of the cylinder drum 5.

According to FIG. 2, the bottom end 40 of the pressure pin 28 according to the prior art, opposite the top end 31 (the end of the cylindrical basic member 34 of the pressure pin 28 expanded by the surface enlargement 32 and the retaining hook 36), only comprises a cylindrical end of the basic member 34, which rests on the return member 26. Wear arises as a result of micro-movements and vibrations of the pressure pins 28 and the pressure pins work their way over the course of time into the return member 26, which is indicated in FIG. 2 in the area 41 of the central bore of the return member 26.

Figure 3:
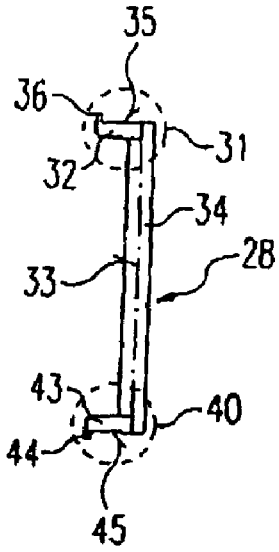
FIG. 3 is a detailed representation of a pressure pin according to the invention.
Figure 5:
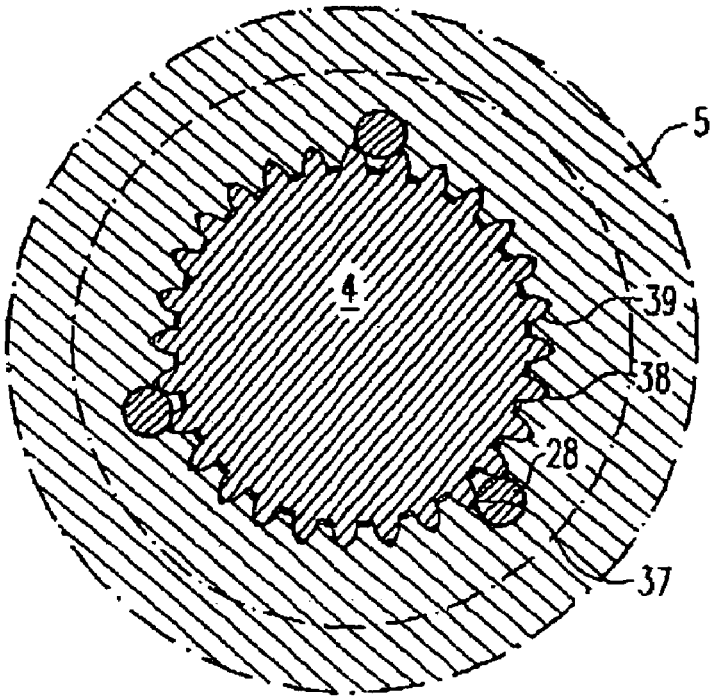
FIG. 5 shows a cross-section in the area V-V in FIG. 4.

In contrast, unlike the pressure pin 28 according to the prior art, FIG. 3 reveals that the pressure pin 28 according to the invention comprises a further surface enlargement 32 and preferably a retaining hook 44 mounted at the outer end of the surface enlargement 43 at its bottom end 40 as well as at its top end 31. The end face of the cylindrical basic member 34 enlarged by the end face of the surface enlargement 43 provides the bottom end 40 of each pressure pin 28 with the bearing surface 45. According to FIG. 4, this rests against the surface 46 of the return member 26 pointing towards the cylinder drum 5. Each pressure pin 28 may be fixed to the return member 26 via the retaining hook 44, which is preferably guided in a bore 47 in the surface 46 of the return member 26.

Through provision of the enlarged, bent-out bearing surface 45 at the bottom end 40 of the pressure pin 28, which surface 45 preferably corresponds to at least double the original end face of the cylindrical basic member 34, the pretensioning force produced by the compression spring 27 and acting via the spring washer 30 on the pressure pins 28 is distributed over a larger surface area, such that the surface pressure exerted by the bearing surface 45 of the pressure pin 28 on the surface 46 of the return member 26 is reduced. The wear suffered by the two surfaces 45 of the pressure pin 28 and 46 of the return member 26 are minimized accordingly during regular operation.

The symmetrical construction of the pressure pins rules out incorrect mounting. The two retaining hooks 36, 44 prevent the pressure pins 28 from being able to slip radially in the pre-assembled state without drive shaft 4. Secure mounting of the pre-assembled driving gear group by means of the spline profile is thereby ensured.

Figure 6:
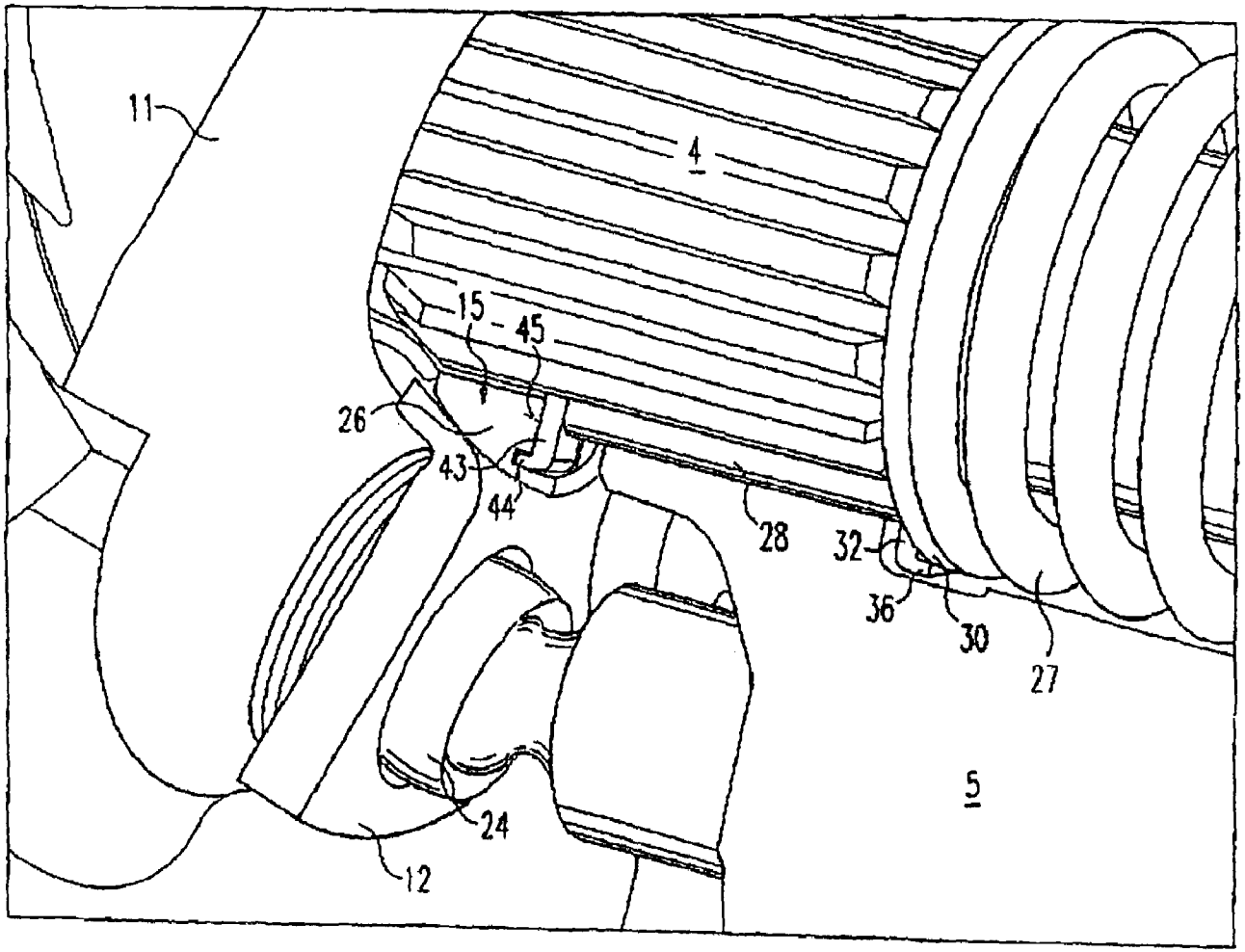
FIG. 6 shows a second exemplary embodiment of the invention.
Figure 7:
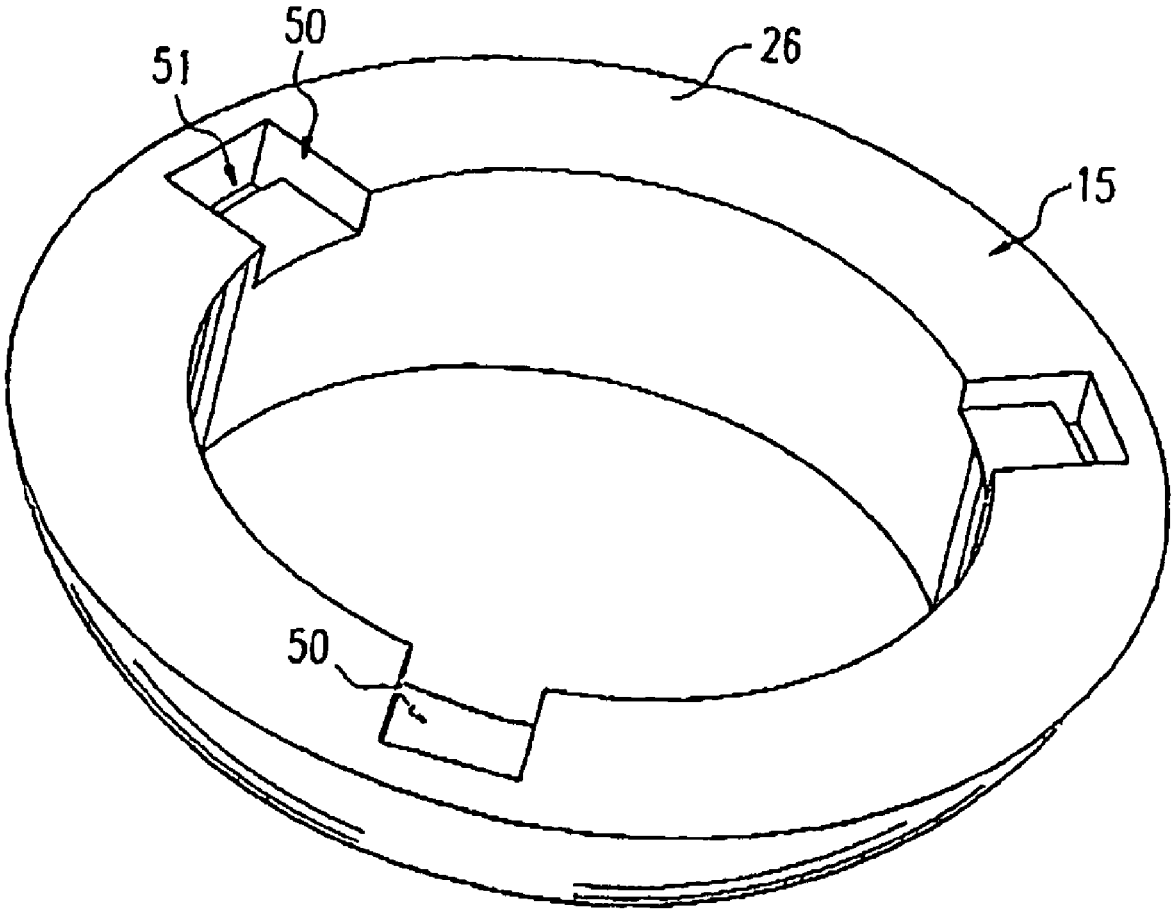
FIG. 7 shows the return means of the exemplary embodiment illustrated in FIG. 6.

FIGS. 6 and 7 show a further exemplary embodiment of the invention. FIG. 6 is a sectional, perspective representation of the components of the axial piston machine relevant to pretensioning of the return member 26. Elements which have already been described are provided with the same reference numerals, such that in this respect the description need not be repeated.

Figure 4:
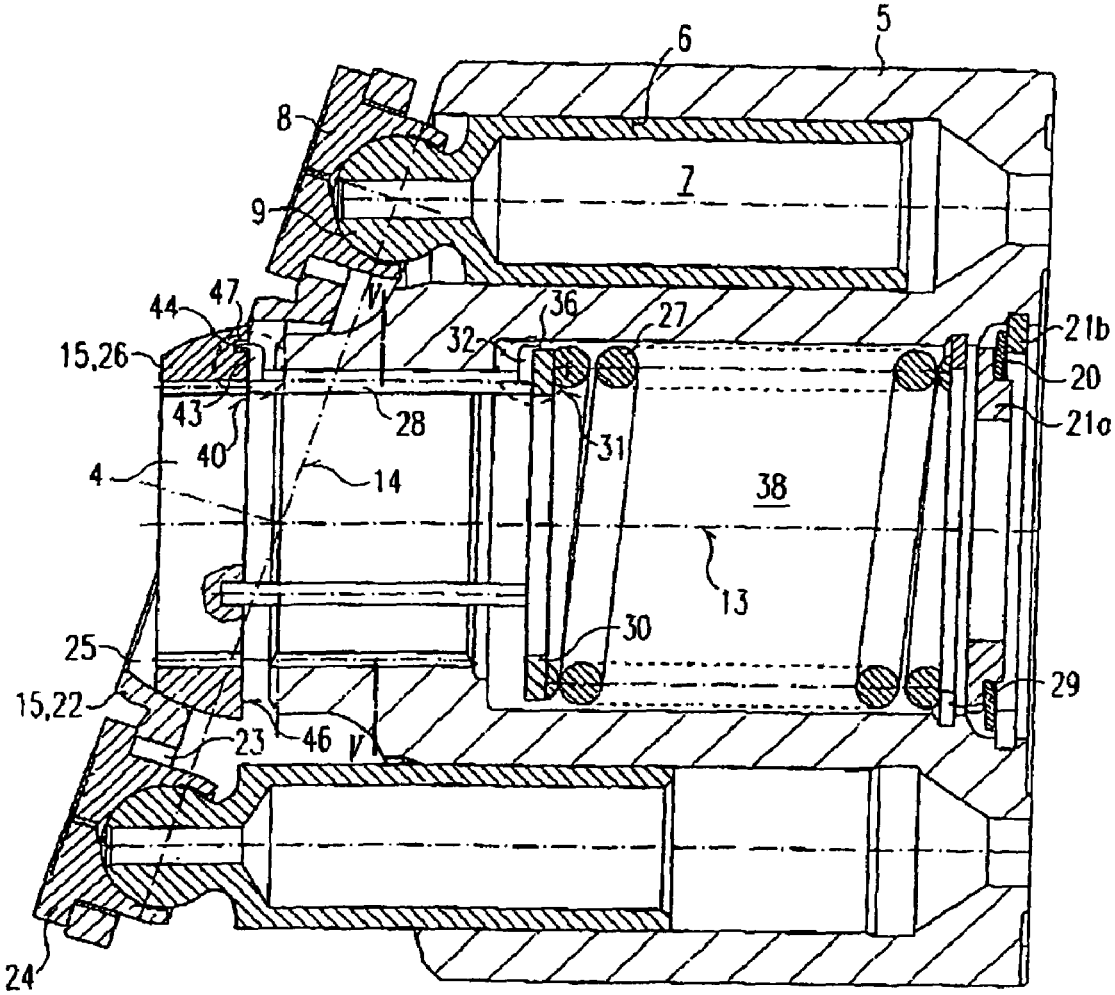
FIG. 4 shows a cross-section through the components of an axial piston machine which are relevant according to the invention to pretensioning of the return member.

In contrast to the exemplary embodiment illustrated in FIG. 4, in which the surface enlargement 43 is not accommodated by the return member 26 but rather rests on the flat surface of the return member 26, in the exemplary embodiment illustrated in FIG. 6 the surface enlargements 43 of the pressure pins 28 engage in corresponding pockets 50 in the return member 26, illustrated more clearly in FIG. 7. This is different from the exemplary embodiment illustrated in FIG. 4, in which it is not the surface enlargements 43 but only the retaining hooks 44 formed thereon which engage in corresponding bores 47. To accommodate the retaining hooks 47, corresponding recesses 51 are provided in the pockets 50.

The advantage of the exemplary embodiment illustrated in FIGS. 6 and 7 is that torque driving of the return member 26 takes place not only via the retaining hook 47 but also via the surface enlargements 43, such that larger torques may be also be transmitted. In the exemplary embodiment illustrated in FIGS. 6 and 7 in particular, the splines of the return member 26 may be dispensed with, as illustrated in FIG. 6. The spline-free return member 26 is guided on the tip circle of the splines of the shaft 4. It goes without saying that the splines on the shaft 4 may be also be dispensed with in the area of the return member, just a bearing surface for the return member 26 being provided on the shaft 4.

The invention claimed is:

1. An axial piston machine having a rotatably mounted cylinder drum possessing a central recess and a plurality of cylinder bores extending approximately coaxially with the central recess, pistons being movably guided in said bores, a swash plate supporting said pistons via guide shoes, recesses in a return plate, in which said guide shoes are guided, a return member being arranged in a central internal bore in the return plate, the return member being exposed to a pretensioning force in the axial direction by a compression spring via a plurality of pressure pins, wherein each pressure pin comprises a planar surface enlargement radial relative to its longitudinal axis at a bottom end thereof facing the return member.

2. An axial piston machine according to claim 1, wherein the pressure pins are arranged equidistantly in a circle concentric to the central recess of said cylinder drum.

3. An axial piston machine according to claim 1, wherein a spring washer transmits the pretensioning force of the compression spring to the pressure pins.

4. An axial piston machine according to claim 3, wherein each said pressure pin comprises a surface enlargement radial relative to its longitudinal axis at the top end thereof opposite its bottom end facing the spring washer.

5. An axial piston machine according to claim 4, wherein a retaining hook is provided at each outer edge of the two surface enlargements of each said pressure pin.

6. An axial piston machine according to claim 5, wherein each said retaining hook at the end of the respective surface enlargement of each said pressure pin projects in each instance approximately perpendicularly out of a bearing surface formed by the end face of a basic member, and in each instance the end face of the surface enlargement.

7. An axial piston machine according to claim 6, wherein a bearing surface, formed from the end face of the planar surface enlargement and the end face of the basic member, at the bottom end of each pressure pin possesses at least twice as large a surface area as the end face of the basic member of the pressure pin.

8. An axial piston machine according to claim 5 wherein each retaining hook at the end of the surface enlargement at the bottom end of each said pressure pin is introduced into an associated opposing bore in the return member.

9. An axial piston machine according to claim 5 wherein at the top end of the pressure pins, the retaining hooks at the end of the surface enlargement enclose the spring washer.

10. An axial piston machine according to claim 4, wherein the outer edges of the bearing surfaces of the surface enlargements at the top end of two diametrically opposed said pressure pins provide a spacing which corresponds to the external diameter of the spring washer.

11. An axial piston machine according to claim 4, wherein selectively, one or both of the two surface enlargements of each said pressure pin is or are located on one side relative to the longitudinal axis of the pressure pin.

12. An axial piston machine according to claim 1, wherein each said pressure pin possesses the same length.

13. An axial piston machine according claim 1, wherein in the central recess of the rotatably mounted cylinder drum, a shaft acts in the manner of a drive through a spline profile and the pressure pins are guided through the spline profile.

14. An axial piston machine having a rotatably mounted cylinder drum possessing a central recess and a plurality of cylinder bores extending approximately coaxially with the central recess, pistons being movably guided in said bores, a swash plate supporting said pistons via guide shoes, recesses in a return plate, in which said guide shoes are guided, a return member being arranged in a central internal bore in the return plate, the return member being exposed to a pretensioning force in the axial direction by a compression spring via a plurality of pressure pins, wherein each pressure pin comprises a planar surface enlargement radial relative to its longitudinal axis at a bottom end thereof facing the return member, and wherein a surface enlargement on each said pressure pin engages into a pocket provided in the return member, at the outer edge of at least one of the surface enlargements of each pressure pin, there is in each case provided a retaining hook, and in that the retaining hook engages in each case in a recess in the associated pocket.

* * * * *